US007313354B2

(12) United States Patent
Tsuda et al.

(10) Patent No.: US 7,313,354 B2
(45) Date of Patent: Dec. 25, 2007

(54) APPARATUS AND METHOD FOR PRODUCING MEMBER HAVING HIDDEN INFORMATION, IMAGE FORMATION APPARATUS, PRINT CONTROL APPARATUS, SERVICE METHOD, AND PROGRAM

(75) Inventors: Yu Tsuda, Kanagawa (JP); Koichiro Shinohara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 145 days.

(21) Appl. No.: 11/030,066

(22) Filed: Jan. 7, 2005

(65) Prior Publication Data

US 2005/0196203 A1 Sep. 8, 2005

(30) Foreign Application Priority Data

Mar. 4, 2004 (JP) ..... P2004-061044

(51) Int. Cl.
*G03G 15/20* (2006.01)

(52) U.S. Cl. ..... 399/341; 399/320

(58) Field of Classification Search ..... 399/341, 399/342

See application file for complete search history.

(56) References Cited

U.S. PATENT DOCUMENTS 6,508,169 B1 * 1/2003 Sato ..... 101/128.21
6,978,035 B2 * 12/2005 Kawaguchi et al. ..... 382/100
6,980,762 B2 * 12/2005 Bogoshian ..... 399/328
2002/0153721 A1 * 10/2002 Brooks et al. ..... 283/114
2002/0191209 A1 * 12/2002 Yasumaru ..... 358/1.14

FOREIGN PATENT DOCUMENTS

| | | | |
|---|---|---|---|
| JP | 63-58374 | | 3/1988 |
| JP | 4-242752 | | 8/1992 |
| JP | 8-11468 | | 1/1996 |
| JP | 10-221877 | | 8/1998 |
| JP | 11-167348 | | 6/1999 |
| JP | 11167348 | * | 6/1999 |

* cited by examiner

*Primary Examiner*—Anjan Deb
*Assistant Examiner*—Jeff Natalini
(74) *Attorney, Agent, or Firm*—Morgan, Lewis & Bockius LLP

(57) ABSTRACT

An apparatus produces a member having hidden information in which a sheet of conceal paper for hiding the information and a sheet of recording paper having an image recorded thereon are bonded releasably. The apparatus includes a recording paper supply section, a conceal paper supply section, and a fixing section. The recording paper supply section supplies the sheet of recording paper. The conceal paper supply section supplies the sheet of conceal paper. The fixing section fixes the image, which is formed on the sheet of recording paper supplied from the recording paper supply section, onto the sheet of recording paper, and bonds the sheet of conceal paper supplied from the conceal paper supply section to the sheet of recording paper simultaneously.

9 Claims, 9 Drawing Sheets

FIG. 7A

| ID | PASSWORD | NAME | ADDRESS | PAYMENT MODE | REMAINDER OF MONEY |
|---|---|---|---|---|---|
| 0001 | ABAB | XXYY | ... KANAGAWA | CREDIT | - |
| 0002 | CDCD | YYZZ | ... TOKYO | PREPAID | 1,000 |
| ⋮ | ⋮ | ⋮ | ⋮ | ⋮ | ⋮ |

FIG. 7B

| DATE | ID | DESTINATION NAME | DESTINATION ADDRESS | DATA | ADVERTISE-MENT | FEE |
|---|---|---|---|---|---|---|
| 3/1 10:41 | 0001 | YYXX | ... OKAYAMA | hagaki/P0001.jpg | PRESENT | 100 |
| 3/2 15:35 | 0002 | ZZYY | ... YAMAGUCHI | hagaki/P0002.jpg | ABSENT | 200 |
| ⋮ | ⋮ | ⋮ | ⋮ | ⋮ | ⋮ | ⋮ |

FIG. 7C

| ADVERTISE-MENT | FEE |
|---|---|
| PRESENT | 100/SHEET |
| ABSENT | 200/SHEET |

CASE WHERE A PART OF A POSTCARD IS HIDDEN

CASE WHERE POSTCARD IS FOLDED INTO TWO

CASE WHERE A PART OF A POSTCARD IS HIDDEN WHILE AN ADVERTISEMENT IS PUT ON A SHEET OF CONCEAL PAPER

APPARATUS AND METHOD FOR PRODUCING MEMBER HAVING HIDDEN INFORMATION, IMAGE FORMATION APPARATUS, PRINT CONTROL APPARATUS, SERVICE METHOD, AND PROGRAM

BACKGROUND OF THE INVENTION

1. Field of the Invention

The present invention relates to a production apparatus for a member having hidden information, for recording the information on the member so that the member maintains secrecy of the information.

2. Description of the Related Art

A proxy service of printing personally generated information on a postcard and mailing the postcard has appeared with the advance of facilitation of high-quality high-gloss printing in recent years. There is however a problem that privacy may be invaded in the middle of mailing or a printed matter may be spoilt because of bending, damaging, polluting, etc. in the middle of transport when a personally generated image such as a family photograph is mailed in the form of a postcard. Accordingly, there is an increasing need to mail a personally generated printed matter such as a postcard in the form of a member having hidden information in which another sheet is bonded onto the printed matter for hiding the information and protecting the surface of the printed matter.

To meet the need, a process of producing such a member having hidden information by means of an image formation apparatus has been made heretofore (e.g. see JP-A-Hei. 8-11468 (page 3 and FIG. 7) and JP-A-Hei. 11-167348 (pages 6-8 and FIGS. 4-5).

SUMMARY OF THE INVENTION

In JP-A-Hei. 8-11468, there is however a problem that the apparatus size cannot be reduced because the step of printing hidden information on a sheet of recording paper and the step of bonding the sheet of recording paper while folding it in the form of a "Z" figure are provided separately.

According to JP-A-Hei. 11-167348, an apparatus for producing a member having hidden information is configured simply in which provided is a device, which serves as a fixing device for fixing a toner image generated by an electrophotographic image generator on a sheet of recording paper and also serves as a device for bonding a sheet of conceal paper to the sheet of recording paper while placing the sheet of recording paper on the sheet of conceal paper. There is however a problem that complex configuration of returning the sheet of recording paper, placing it in the sheet of conceal paper and heating the sheet of conceal paper by the fixing device to bond the sheet of conceal paper to the sheet of recording paper again is required after the sheet of recording paper having the toner image supported thereon is once passed through the fixing device.

The invention intends to solve the aforementioned technical problems and provides an apparatus, which is small in size, easy to maintain, and produces a member having hidden information.

The invention also provides a method of producing a member having member having hidden information, in which an image designated by a user is concealed, and mailing it.

For the foregoing objects, one embodiment of the invention does not adopt a method for forming an image on an adhesive layer surface provided on a sheet of recording paper, but adopts a method for forming the image on the sheet of recording paper directly. Moreover, fixation of the image on the sheet of recording paper and bonding of a sheet of conceal paper to the sheet of recording paper are performed simultaneously. That is, according to one embodiment of the invention, an apparatus produces a member having hidden information in which a sheet of conceal paper for hiding the information and a sheet of recording paper having an image recorded thereon are bonded releasably. The apparatus includes a recording paper supply section, a conceal paper supply section, and a fixing section. The recording paper supply section supplies the sheet of recording paper. The conceal paper supply section supplies the sheet of conceal paper. The fixing section fixes the image, which is formed on the sheet of recording paper supplied from the recording paper supply section, onto the sheet of recording paper, and bonds the sheet of conceal paper supplied from the conceal paper supply section to the sheet of recording paper simultaneously.

One embodiment of the invention may be grasped as a method for producing a member having hidden information in which a sheet of conceal paper for hiding information is releasably bonded to a sheet of recording paper having an image recorded thereon. In this case, the method for producing the member having the hidden information includes supplying the sheet of recording paper; supplying the sheet of conceal paper; and simultaneously fixing the image, which is formed on the sheet of recording paper supplied, onto the sheet of recording paper, and bonding the sheet of conceal paper supplied to the sheet of recording paper.

Also, one embodiment of the invention may be grasped as an image formation apparatus having a function of producing a member having hidden information. In this case, an image formation apparatus includes an image carrier, a recording paper supply section, a transfer section, a conceal paper supply section, and a fixing section. The image carrier carries a toner image. The recording paper supply section supplies a sheet of recording paper. The transfer section transfers the toner image, which is carried on the image carrier, onto the sheet of recording paper supplied from the recording paper supply section. The conceal paper supply section supplies a sheet of conceal paper for hiding information. The fixing section fixes the image, which is transferred by the transfer section, onto the sheet of recording paper, and bonds the sheet of conceal paper supplied from the conceal paper supply section to the sheet of recording paper simultaneously.

Also, one embodiment of the invention provides a service for producing a member having hidden information by using an image formation apparatus having a function of releasably bonding a sheet of recording paper and a sheet of conceal paper to each other.

A print controller (server computer) in such a service is connected to the image formation apparatus. The print controller includes an image data acquisition section, a hidden region specifying section, and an image formation instruction section. The image data acquisition section acquires image data. The hidden region specifying section specifies at least a part of the image data acquired by the image data acquisition section as a region to be hidden. The image formation instruction section instructs the image formation apparatus to form an image based on the image data acquired by the image data acquisition section on the sheet of recording paper and instructs the image formation apparatus to bond the sheet of conceal paper to the sheet of recording paper so that the region of the formed image specified by the hidden information specifying section is hidden.

A method for such a service is a method for producing a member having hidden information in accordance with a user's instruction. In the member having the hidden information, a sheet of recording paper and a sheet of conceal paper are releasably bonded to each other. The method for such a service includes acquiring image data; specifying at least a part of the acquired image data as a region to be hidden; storing the acquired image data in such a manner that the region to be hidden is recognized clearly; and forming an image on the sheet of recording paper on the basis of the stored image data while bonding the sheet of conceal paper to the sheet of recording paper so that the region to be hidden in the formed image is hidden, to produce the member having the hidden information.

A program for achieving such a service.

A storage medium is readable by a computer. The storage medium stores a program of instructions for achieving such a service. The program is executable by the computer to perform a function includes acquiring image data; specifying at least a part of the acquired image data as a region to be hidden; and instructing an image formation apparatus to form an image based on the acquired image data on a sheet of recording paper and instructing the image formation apparatus to bond a sheet of conceal paper to the sheet of recording paper so that the specified region to be hidden in the formed image is hidden.

According to one embodiment of the invention, a member having hidden information can be produced by an apparatus small in size and easy to maintain.

BRIEF DESCRIPTION OF THE DRAWINGS

Preferred embodiments of the invention will be described in detail based on the following drawings, wherein:

FIGS. 7A to 7C are views showing examples of information stored in respective storage sections in the third embodiment of the invention;

DETAILED DESCRIPTION OF THE PREFERRED EMBODIMENTS

Embodiments of the invention will be described below in detail with reference to the accompanying drawings.

First Embodiment

Figure 1:
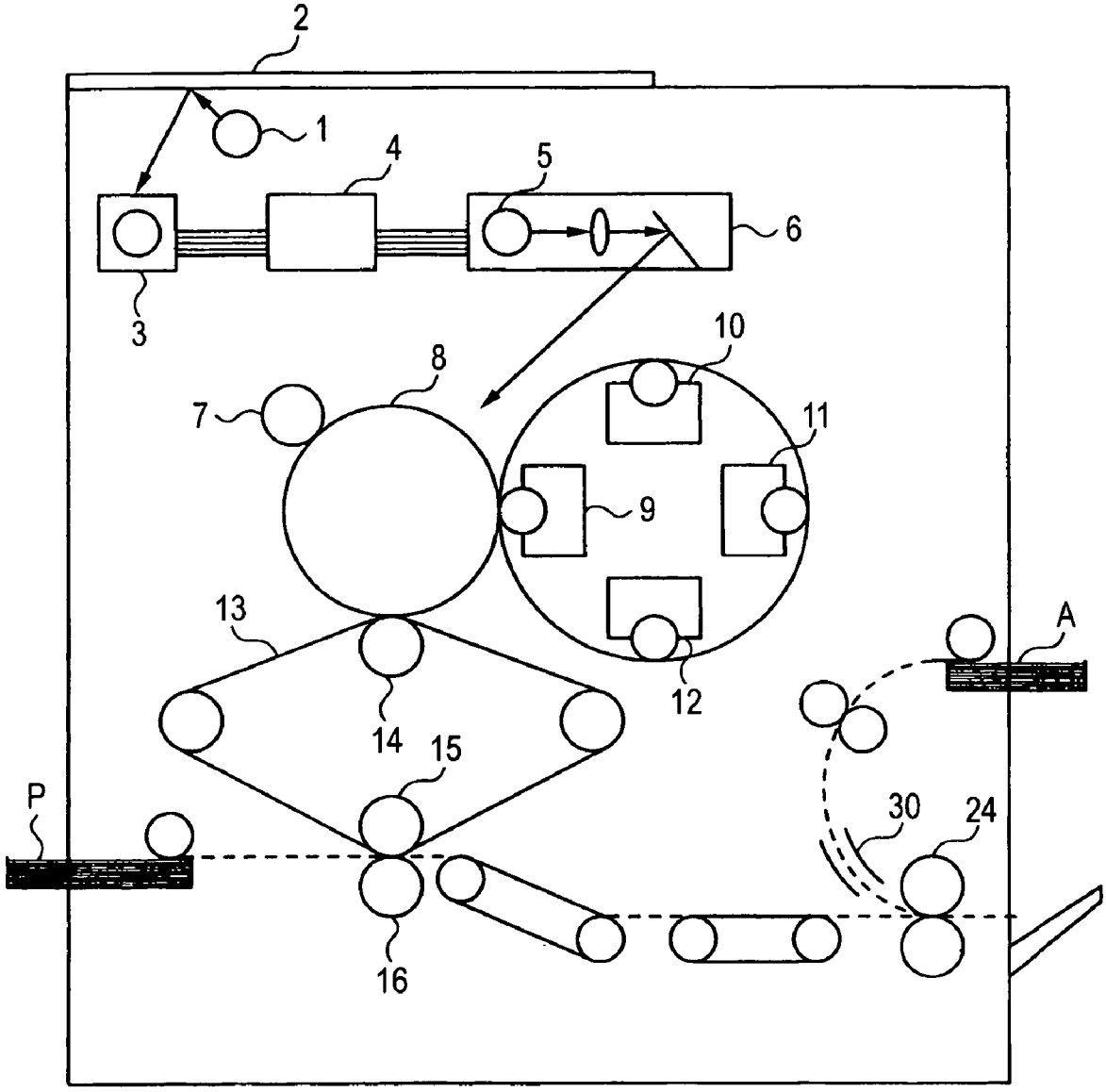
FIG. 1 is a diagram showing the configuration of an image formation apparatus according to a first embodiment of the invention.

FIG. 1 shows the schematic configuration of an image formation apparatus according to a first embodiment of the invention.

As shown in FIG. 1, the image formation apparatus according to this embodiment has an illuminator 1, a color scanner 3, an image processor 4, a laser diode 5, an optical system (ROS) 6, a charger 7 serving as a charging device, an organic photoconductor 8 serving as a electrophotographic photoconductor, a yellow developer 9, a magenta developer 10, a cyan developer 11, a black developer 12, a transfer belt 13, a semiconductor soft roll 14, a pair of semiconductor soft rolls 15 and 16, a paper carrying guide 30, and a pair of heat rolls 24. The illuminator 1, the color scanner 3, the image processor 4, the laser diode 5 and the optical system (ROS) 6 serve as an image exposure device. The yellow developer 9, the magenta developer 10, the cyan developer 11 and the black developer 12 serve as a developing device. The transfer belt 13 serves as an intermediate transfer member and comes into contact with the organic photoconductor 8 at a transfer position. The semiconductor soft roll 14 serves as a first transfer device and is disposed opposite to the organic photoconductor 8 at the transfer position with sandwiching the transfer belt 13 therebetween. The pair of semiconductor soft rolls 15 and 16 serve as a second transfer device. A bias voltage is applied to the soft roll 15 while the soft roll 16 is grounded. The transfer belt 13 and a sheet of recording paper P are put between the pair of semiconductor soft rolls 15 and 16. The paper carrying guide 30 serves as a conceal-paper placing device. The pair of heat rolls 24 serve as a fixing device. Incidentally, the reference numeral 2 designates an original document for forming an image.

Next, configurations of the respective members of the image formation apparatus and toner used therein will be described in detail.

-Developing Device-

For example, the developing device is a color toner developing device, which is a device for forming electrically insulating color toner on an electrophotographic photoconductor. Any known developing device may be used as long as it is equivalent to this device. For example, a known developer having a function of depositing toner on an electrophotographic photoconductor by using a brush, a roller or the like may be used as a part of the developing device. Known is a developing device for forming a color image on a transfer member by using transparent toner and color toner mixed with a known carrier and electrically charged. For example, a known device described in JP-A-Sho.63-58374, contents of which are incorporated herein by reference in its entirety, may be used as the developing device. The developing device operates as follows. For example, a charger first electrically charges an electrophotographic photoconductor. The electrophotographic photoconductor is exposed to a light image by the image exposure device, so that an electrostatic latent image is formed on the electrophotographic photoconductor. The developing device filled with color toner develops the electrostatic latent image, so that a color image based on transparent toner and color toner is formed on the electrophotographic photoconductor. The color image is transferred onto the transfer member. Alternatively, a developing device using a one-component developing agent without any carrier may be used for forming such a color image.

-Electrophotographic Photoconductor-

The electrophotographic photoconductor is not particularly limited. Any known device may be used as the electrophotographic photoconductor. The electrophotographic photoconductor may have a single layer structure or a multi-layer structure of a separated-function type. A material of the electrophotographic photoconductor may be an inorganic material such as selenium or amorphous silicon, or may be an organic material.

-Intermediate Transfer Member-

The intermediate transfer member is used for transferring the color toner image on the electrophotographic photoconductor. The half-value period of electric potential needs to be equal to or larger than 0.05 sec and equal to or shorter than 1.0 sec when the surface of the intermediate transfer member is electrically charged with 500 V evenly. If the half-value period is shorter than 0.05 sec, the first transfer device cannot transfer the color toner image onto the intermediate transfer member evenly and cannot be transferred onto a transfer member evenly by the second transfer device. A known intermediate transfer member may be used as long as it satisfies the limitation of the half-value period.

The intermediate transfer member having the half-value period adjusted as described above can be prepared by dispersing electrically conductive inorganic powder such as electrically conductive carbon or an electrically conductive high-molecular compound such as polyaniline into a dielectric such as polyimide. The half-value period is defined as a time (inclusive moving time of 0.05 sec) until the electric potential of the front surface of the intermediate transfer member reaches −250 V when reduction in electric potential of the surface thereof is measured in the condition that the intermediate transfer member is moved just under a potentiometer within 0.05 sec after the surface of the intermediate transfer member is initially electrically charged with −500 V by a charging scorotron while the rear surface of the intermediate transfer member is grounded.

-First Transfer Device-

Examples of the first transfer device include: a device for generating an electric field between the electrophotographic photoconductor and the intermediate transfer member by using an electrically conductive or electrically semiconductive roller, brush, film, rubber blade or the like supplied with a voltage, thereby transferring charged toner particles; and a device for corona-charging the rear surface of the intermediate transfer member by a corotron or scorotron charger using corona discharge, thereby transferring charged toner particles.

-Second Transfer Device-

A transfer device known in itself may be used as the second transfer device by which the toner image on the intermediate transfer member is transferred onto a transfer member. Examples of the second transfer device include: a device for generating an electric field between the intermediate transfer member and a transfer member by using a pair of electrically conductive or electrically semiconductive rollers or the like supplied with a voltage, thereby transferring the charged toner particles; and a device for corona-charging the rear surface of the intermediate transfer member or the rear surface of the transfer member through a counter electrode provided opposite to a corotron or scorotron charger provided on the rear surface of the intermediate transfer member or the rear surface of the transfer member, thereby transferring the charged toner particles.

-Color Toner-

The color toner is provided as electrically insulating particles containing at least a binder resin and a coloring agent. Examples of the color toner include cyan toner, magenta toner, yellow toner, and black toner. The composition, mean particle size, etc. of the color toner may be selected suitably if the object of the invention is not spoiled.

Examples of the binder resin include materials, which will be listed in the following description of a binder resin contained in transparent toner. Polyester having a weight-average molecular weight of 5000 to 12000 is preferred as the binder resin from the point of view of combination with the heat roll fixing device. The coloring agent is not particularly limited as long as it is a coloring agent generally used for toner. Any pigment or dye may be selected from a cyan pigment or dye, a magenta pigment or dye, a yellow pigment or dye and a black pigment or dye, which are known. Preferably, suppression of irregular reflection on an interface between the pigment of the coloring agent and the binder is important to improve the effect of obtaining a high gloss. Combination of the binder and the coloring agent having a small particle size pigment highly dispersed therein as described in JP-A-Hei. 4-242752, contents of which are incorporated herein by reference in its entirety, is effective in suppressing the irregular reflection.

Although it is unnecessary to limit the particle size of the color toner particularly, a particle size in a range of from 4 μm to 8 μm is preferred in consideration of the fact that the color toner must have a function capable of faithfully reproducing the electrostatic latent image formed by the image exposure device.

In the embodiments of the invention, the color toner may be produced suitably or may be a commercially available product.

The transparent toner and color toner are used after combined with a carrier selected suitably and known in itself to form a developing agent. Alternatively, there may be used a device for electrically charging the transparent toner and color toner as a one-component developing agent by friction with a developing sleeve or a charger member to form electrically charged toner and performing development in accordance with the electrostatic latent image.

-Conceal-Paper Placing Device-

A transporting device having a function of transporting a sheet of conceal paper and placing the sheet of conceal paper on a predetermined position of a recording paper may be used as the conceal-paper placing device.

-Fixing Device-

A known fixing device may be used as the fixing device for performing fixation of the toner image and the transparent image formed on a sheet of recording paper and adhesion of a sheet of conceal paper to the sheet of recording paper, simultaneously. Incidentally, the sheet of conceal paper can be separated from the sheet of recording paper after the adhesion. For example, a heat roll fixing device using a heat roll and a pressure roll for fixing toner by fusing and deforming the toner may be used as the fixing device.

-Conceal Paper A-

Figure 2A:
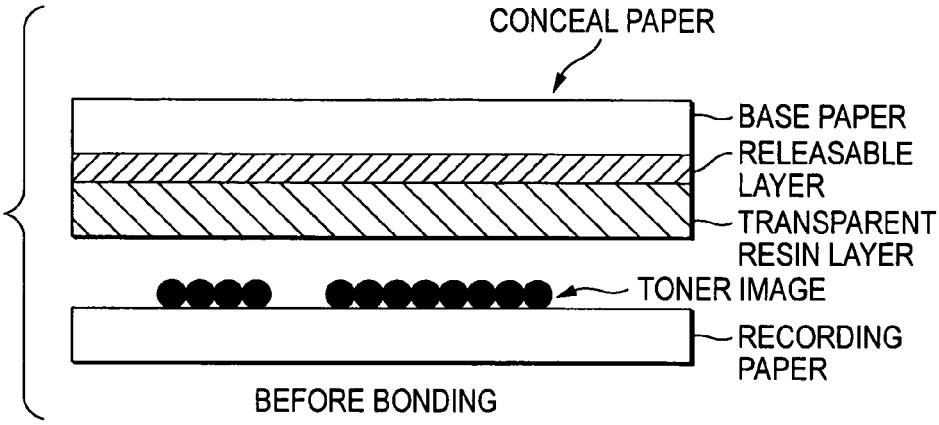
FIGS. 2A to 2C are views for explaining a process for producing a member having hidden information in the first embodiment of the invention.
Figure 2B:
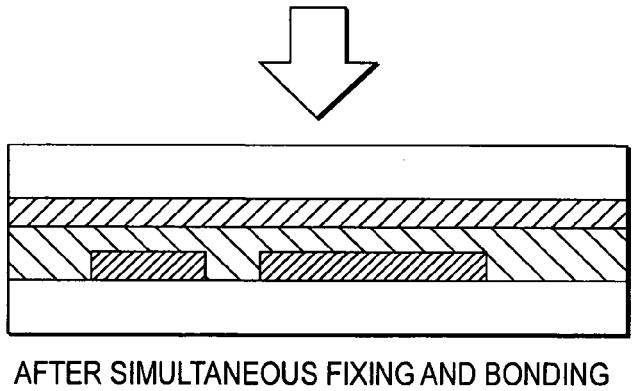
Figure 2C:
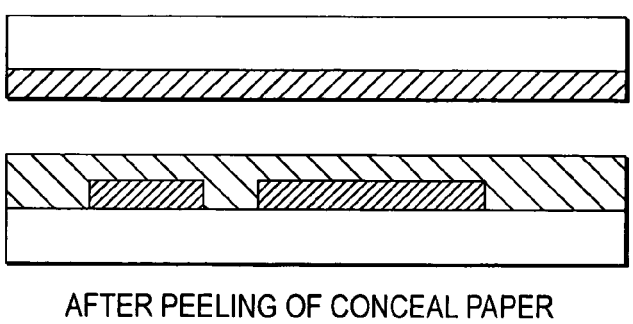

In this embodiment, as shown in FIGS. 2A to 2C, the color toner image transferred from the intermediate transfer member onto the sheet of recording paper is bonded to the sheet of conceal paper having the transparent resin layer formed in advance. Thus, a member having hidden information is formed. The conceal paper used in this embodiment will be hereinafter referred to as "conceal paper A". The conceal paper A has a structure in which a transparent resin layer made of a polyester resin is provided on a releasable layer, which includes a surface active agent, a leveling agent, low-molecular wax and a releasing assistant and is provided on at least one surface of a sheet of base paper (e.g. see JP-A-Hei. 10-221877, contents of which are incorporated herein by reference in its entirety).

For example, regular paper, coated paper, art paper, cast-coated paper or the like may be selected as the base paper of the conceal paper A in accordance with the target gloss. The base paper is however not limited thereto. A sheet of synthetic paper, a plastic film or the like may be also used.

Examples of the polyester resin used for forming the transparent resin layer include: a polyester resin made of bisphenol A ethylene oxide adduct/bisphenol A propylene oxide adduct/terephthalic acid/glycerol as monomers; a polyester resin made of bisphenol A propylene oxide adduct/fumaric acid as monomers; a polyester resin made of bisphenol A ethylene oxide adduct/dodecynyl succinate/terephthalic acid as monomers; and a polyester resin made of bisphenol A ethylene glycol adduct/fumaric acid/isopropylene glycol as monomers. The polyester resin is not limited thereto.

A resin containing surface active agent, a leveling agent, low-molecular wax, a releasing assistant, etc. may be used as the material of the resin layer used for forming the releasable layer.

Examples of a lubricant used include: higher fatty acid such as stearic acid; higher fatty acid metal salt such as zinc stearate; higher fatty acid amide such as amide stearate; methylol compounds thereof; and hydrocarbon such as polyethylene wax. The particle size of the lubricant is preferably selected to be not larger than 8 μm.

Next, the operation of the image formation apparatus according to this embodiment will be described.

The image formation apparatus shown in FIG. 1 performs color copying as follows. First, the document 2 to be copied is irradiated with light emitted from the illuminator 1. Light reflected from the document 2 is color-separated by the color scanner 3 and image-processed by the image processor 4. Thus, color-corrected image data of color toners for a plurality of colors are converted into modulated laser beams by the laser diode 5 in accordance with the colors. The laser beams are color-by-color applied on the organic photoconductor 8 charged with a predetermined electric potential by the charger 7. Thus, a plurality of electrostatic latent images are formed. The plurality of electrostatic latent images are developed successively with four color toners of yellow, magenta, cyan and black by the yellow developer 9, the magenta developer 10, the cyan developer 11 and the black developer 12. The developed color toner images are transferred from the organic photoconductor 8 on to the transfer belt 13 by the semiconductive soft roll 14. After transferred onto the transfer belt 13, the four-color toner images are transferred from the transfer belt 13 onto a sheet of recording paper P by the second transfer device.

A sheet of conceal paper A carried by the paper carrying guide 30 is put on the non-fixed toner image surface of the sheet of recording paper P. The non-fixed toner is heated and fixed by the heat rolls 24 while the sheet of conceal paper A is bonded to the sheet of recording paper P. Thus, a member having hidden information is formed. On this occasion, the transparent resin layer applied on the sheet of conceal paper A is fused to the sheet of recording paper P and the toner by heat due to the heat rolls 24, so that the transparent resin layer has high adhesive power. On the other hand, the transparent resin layer is applied on the sheet of conceal paper A through the releasing assistant so that the transparent resin layer can be released from the sheet of conceal paper A. Accordingly, even after heating and fixing, the adhesive power between the sheet of conceal paper A and the transparent resin layer is so weak that the sheet of conceal paper A and the transparent resin layer can be separated from each other when predetermined peeling force is applied. The surface characteristic of the transparent resin layer released from the sheet of conceal paper A is decided by the surface characteristic of the sheet of base paper used for the conceal paper A. When the sheet of conceal paper having the transparent resin layer applied on a sheet of high-gloss base paper through the releasing assistant is used, a member having hidden information, which has a high-gloss electrophotographic image, can be formed.

This embodiment will be described below in detail on the basis of a specific example. However, the invention is not limited to this example at all.

The image formation apparatus shown in FIG. 1 is used as an image formation apparatus in this example. The sheet of conceal paper A has the transparent resin layer applied on the releasable layer in advance. The toner image is electrostatically transferred onto the sheet of recording paper P by electrophotography. The toner image surface of the sheet of recording paper P put on the transparent resin surface of the sheet of conceal paper A is pressed while heated by the heat rolls 24. Fixation of the image formed by electrophotography and bonding of the sheet of conceal paper are performed simultaneously to produce a member having hidden information. Although the sheet of conceal paper A and the sheet of recording paper Pare temporarily bonded to each other, they can be separated from each other easily in accordance with necessity after the member having the hidden information is produced. At the time of separation, the transparent resin layer supported by the sheet of conceal paper A is transferred to the recording paper P side. Thus, the transparent layer coating the high-gloss transferred toner image having image information on the sheet of recording paper P can be formed.

There are various kinds of modes for placing the sheet of conceal paper A on the sheet of recording paper P. Examples of such modes include: a mode in which the sheet of conceal paper A having the transparent layer formed on the releasable layer in advance is put on the toner image surface of the sheet of recording paper P having the image electrostatically transferred by electrophotography; and a mode in which a sheet of recording paper P having a releasable layer formed on a half surface of the sheet of recording paper P in advance, a transparent layer is applied on the releasable layer, and then the sheet of recording paper P is folded into two after a toner image is electrostatically transferred onto the sheet of recording paper P by electrophotography. Each mode may be applied to postcards, notices, various forms, various cards, etc. in which two facing pages are temporarily bonded to each other but can be separated from each other easily in accordance with necessity.

Next, detailed conditions for this embodiment will be described.

-Color Toner Developing Agent-

In this embodiment, cyan, magenta, yellow and black developing agents for "A-Color" made by Fuji-Xerox Co., Ltd. are used as the color toner developing agents. The mean particle size of each color toner is 7 μm.

-Recording Medium-

"OK Special Art Paper" made by Oji Paper Co., Ltd. is used as the recording medium for formation of a color image.

-Weight of Developed Color Toner and Image Signal-

The weight of developed color toner for each color is selected to be 0.5 (mg/cm$^2$) in an image signal Cin=100%. The image processor corrects the color, gradation and sharpness of data read by the scanner to generate an image signal for each color toner.

-Intermediate Transfer Member and Charging of Color Toner Image-

A belt made of a polyimide resin containing electrically conductive carbon particles dispersed therein is used as the intermediate transfer member. The half-value period is 0.1 sec. The charging electric potential is selected to be −500 V.

-Conceal Paper-

The method of producing conceal paper will be described. The polyester resin used in this embodiment is dissolved in ethyl acetate, applied on a sheet of base paper by a bar coating method and dried.

A sheet of mirror coated paper (made by Oji Paper Co., Ltd.) having a basic weight of 127.9 g/m$^2$ is prepared. Into ethyl acetate, 25% by weight of polyester resin NE328-1 is added and 1.5% by weight (with respect to the polyester resin) of a surface active agent ("Elegan LD-204" made by Nissan/NOF Corp.) is added to prepare a solution. The solution is applied on the sheet of mirror coated paper by a bar coating method so that the coating thickness of the dried transparent resin layer is 12 μm. Thus, a sheet of conceal paper is produced.

As described above, in this embodiment, because fixation of non-fixed toner to the sheet of recording paper P and bonding of the sheet of conceal paper A to the sheet of paper P are performed by a single fixing device and simultaneously, a member having hidden information can be produced by an apparatus small in size and easy to maintain.

This embodiment has a secondary effect that production efficiency can be improved when a high-gloss electrophotographic image is formed. For example, if a smooth and uniform-gloss image is formed on a sheet of recording paper in such a manner that a belt surface brought into close contact with an image on the sheet of recording paper is heated by a belt-like fixing device, and that the sheet of recording paper is separated from the belt after cooling, production efficiency cannot be improved because it is necessary to separate the sheet of recording paper from the belt after a sufficient cooling time. On the contrary, in this embodiment, such a cooling time is not required because a member having hidden information is produced so that the sheet of conceal paper can be released when hidden information is to be viewed.

Second Embodiment

Figure 3:
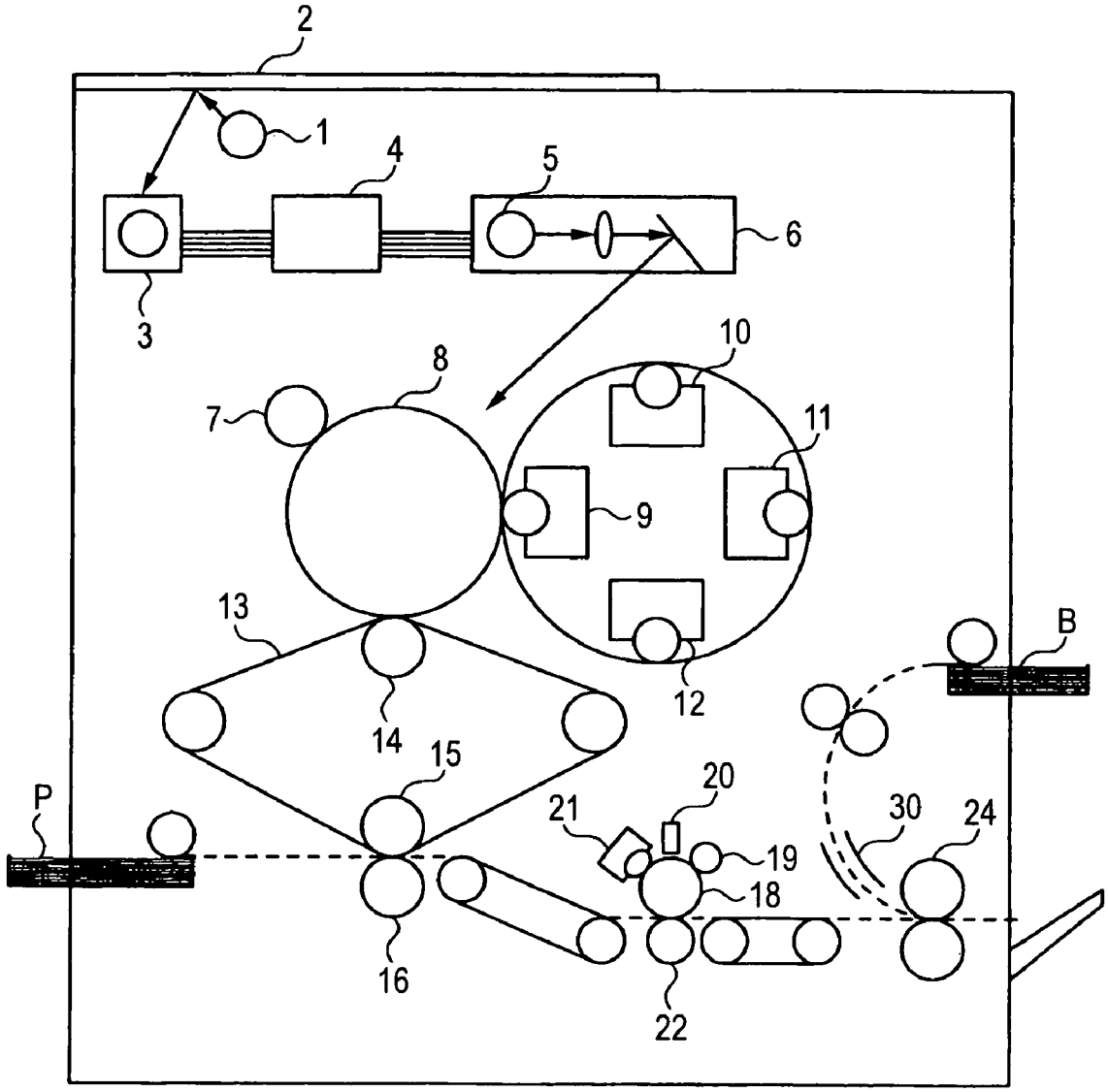
FIG. 3 is a diagram showing the configuration of an image formation apparatus according to a second embodiment of the invention.

FIG. 3 shows the schematic configuration of an image formation apparatus according to a second embodiment of the invention.

As shown in FIG. 3, the image formation apparatus according to this embodiment has a transparent toner layer producer in addition to the configuration shown in FIG. 1. The transparent toner layer producer includes a photoconductive drum 18, a charger 19, an image exposure device 20, a transparent toner developing device 21, and a transfer device 22.

Next, the respective configurations of the constituent members of the image formation apparatus and toners used in the image formation apparatus will be described in detail. Incidentally, the description of ones of the configurations existing in the image formation apparatus according to the first embodiment and ones of the toners used in the image formation apparatus according to the first embodiment will be omitted.

-Transparent Toner Developing Device-

A two-component developing device or a one-component developing device known in itself may be used as the transparent toner developing device. The function of the transparent toner developing device is unchanged regardless of the position of the transparent toner developing device if the transparent toner layer is provided before the sheet of recording paper and the sheet of conceal paper are stacked on each other.

-Transparent Toner-

The transparent toner contains at least a binder resin.

In this embodiment, the term "transparent toner" means toner particles containing no coloring agent (coloring pigment, coloring dye, black carbon particles, black magnetic powder, etc.) aiming at coloring due to light absorption or light scattering. The transparent toner of this embodiment is generally transparent and colorless. Although the transparency of the transparent toner may be slightly lowered in accordance with the kind or amount of a fluidizing agent or a releasing agent contained in the transparent toner, the transparent toner is substantially transparent and colorless.

Any binder resin may be selected suitably in accordance with the purpose as long as it is substantially transparent. A known resin or a copolymer of known resins used for general toner may be used as the binder resin. Examples of the binder resin include a polyester resin, a polystyrene resin, a polyacrylic resin, other vinyl resins, a polycarbonate resin, a polyamide resin, a polyimide resin, an epoxy resin, and a polyurea resin. Of these, a polyester resin is preferred because it can satisfy toner characteristics such as low-temperature fixing characteristic, fixing strength, conservativeness, etc. simultaneously. In consideration of the fact that the transparent toner is used in combination with the heat roll fixing device, polyester having a weight-average molecular weight of from 5,000 to 12,000 is preferably used as the binder resin.

Incidentally, to obtain a high gloss uniformly in the transparent toner, it is necessary to control fluidity and charging property of toner. From the point of view of controlling the fluidity and charging property of the transparent toner, it is preferable that inorganic fine particles and/or resin fine particles are externally added to or deposited on toner particle surfaces of the transparent toner.

The inorganic fine particles are not particularly limited if the effect of the invention is not spoilt. Any inorganic fine particles may be selected suitably from known fine particles used as external additives in accordance with the purpose. Examples of the material of the inorganic fine particles include silica, titanium dioxide, tin oxide, and molybdenum oxide. In consideration of stability such as charging property, these inorganic fine particles may be hydrophobic-treated with a silane coupling agent, a titanium coupling agent or the like.

The organic fine particles are not particularly limited if the effect of the invention is not spoilt. Any organic fine particles can be selected suitably from known fine particles used as external additives in accordance with the purpose. Examples of the material of the organic fine particles include a polyester resin, a polystyrene resin, a polyacrylic resin, a vinyl resin, a polycarbonate resin, a polyamide resin, a polyimide resin, an epoxy resin, a polyurea resin, and a fluororesin.

It is especially preferable that the mean particle size of the inorganic and organic fine particles is from 0.005 to 1 μm. If the mean particle size is smaller than 0.005 μm, the inorganic and/or organic fine particles may be coagulated so that the desired effect cannot be obtained when the inorganic and/or organic fine particles are deposited on the particle surfaces of the transparent toner. If the mean particle size is larger than 1 μm, it is difficult to obtain a higher-gloss image.

Although the particle size of the transparent toner need not be particularly limited, it is preferable from the point of view of preventing disturbance of the color toner image that the particle size of the transparent toner is from 8 μm to 20 μm, both inclusively. If the particle size is smaller than 8 μm, the color toner image is apt to be disturbed because it is necessary to apply a high electrode field between the developing device and the intermediate transfer member. If the particle size is larger than 20 μm, an uniform image cannot be formed because it is difficult to develop the transparent toner exactly in a gap of the color toner image.

Next, the paper used in the embodiment will be described in detail.

-Conceal Paper B-

Figure 4A:
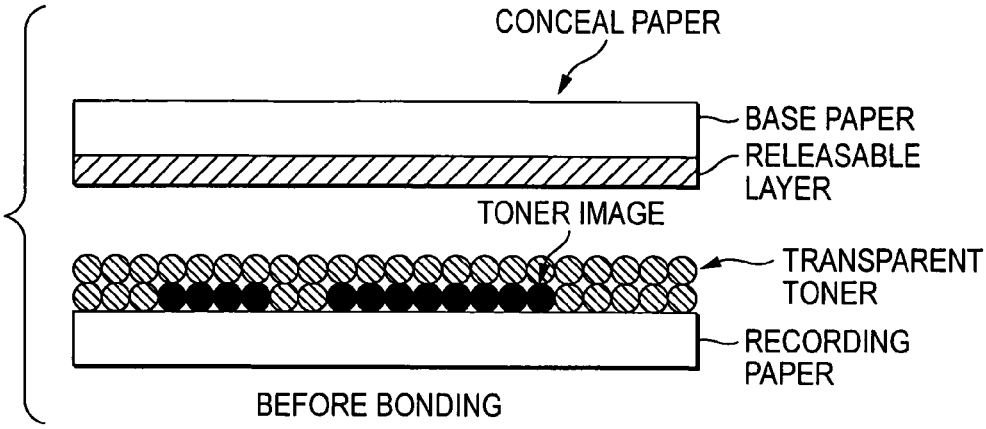
FIGS. 4A to 4C are views for explaining a process for producing a member having hidden information in the second embodiment of the invention.
Figure 4B:
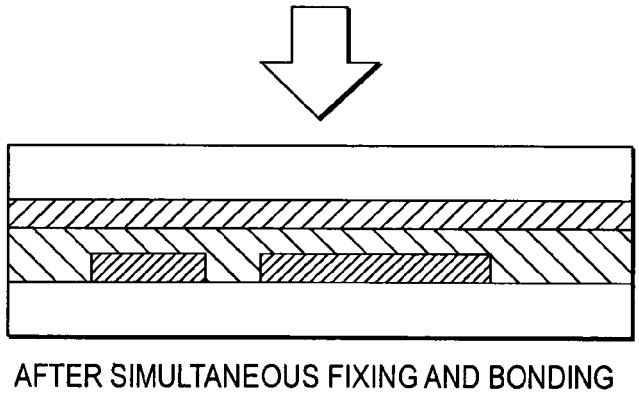
Figure 4C:
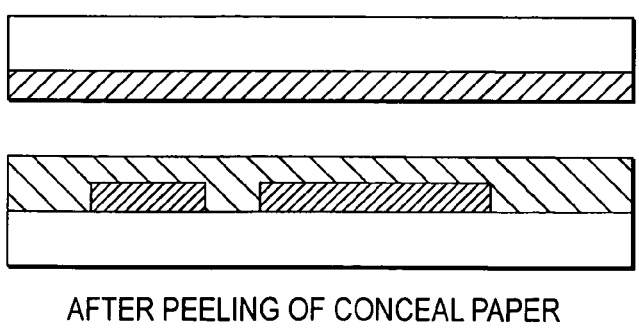

In this embodiment, as shown in FIGS. 4A to 4C, a sheet of conceal paper is put on an image composed of a color toner image transferred from the intermediate transfer member onto the sheet of recording paper and a transparent toner layer formed by the transparent toner developing device. Thus, a member having hidden information is produced. The conceal paper used in this embodiment will be hereinafter referred to as "conceal paper B". Any paper may be selected as the conceal paper B in accordance with the target gloss after releasing. For example, regular paper, print coated paper, art paper, cast-coated paper or the like may be selected as the conceal paper B. From the point of view of releasability, a sheet of paper having a surface made of a surface active agent, a leveling agent, low-molecular wax, a releasing assistant or a highly releasable resin layer such as tetrafluoroethylene-perfluoroalkyl vinyl ether copolymer or polytetrafluoroethylene can be used. However, the conceal paper B is not limited thereto. A sheet of synthetic paper having a surface coated with a silicone resin and/or a fluororesin, a plastic film or the like may be used.

Next, the operation of the image formation apparatus according to this embodiment will be described.

The image formation apparatus shown in FIG. 3 performs color copying as follows. First, the document 2 to be copied is irradiated with light emitted from the illuminator 1. Light reflected from the document 2 is color-separated by the color scanner 3 and image-processed by the image processor 4. Thus, color-corrected image data of color toners for a plurality of colors are converted into modulated laser beams by the laser diode 5 in accordance with the colors. The laser beams are color-by-color applied on the organic photoconductor 8 charged with a predetermined electric potential by the charger 7. Thus, a plurality of electrostatic latent images are formed. The plurality of electrostatic latent images are developed successively with four color toners of yellow, magenta, cyan and black by the yellow developer 9, the magenta developer 10, the cyan developer 11 and the black developer 12. The developed color toner images are transferred from the organic photoconductor 8 onto the transfer belt 13 by the semiconductive soft roll 14. After transferred onto the transfer belt 13, the four-color toner images are transferred from the transfer belt 13 onto a sheet of recording paper P by the second transfer device.

On the other hand, the photoconductive drum 18 charged with a predetermined electric potential by the charger 19 is irradiated with a laser beam emitted from the image exposure device 20. Thus, an electrostatic latent image is formed. The electrostatic latent image is developed by the transparent toner developing device 21. The developed transparent toner image is transferred from the photoconductive drum 18 onto the sheet of recording paper P by the transfer device 22.

Then, the sheet of conceal paper B carried by the paper carrying guide 30 is put on a surface of the sheet of recording paper P where the non-fixed toner image and the transparent toner layer are formed. Thermal fixation of the non-fixed toner and the transparent toner and bonding of the sheet of conceal paper B are performed by the heat rolls 24. Thus, a member having hidden information is formed. On this occasion, the transparent resin layer formed on the sheet of recording paper P is fused to the sheet of recording paper P and the toner by heat due to the heat rolls 24, so that the transparent resin layer has high adhesive power. On the other hand, the transparent resin layer is applied on the sheet of conceal paper B through the releasing assistant so that the transparent resin layer can be released from the sheet of conceal paper B. Accordingly, even after heating and fixing, the adhesive power between the sheet of conceal paper B and the transparent resin layer is so weak that the sheet of conceal paper B and the transparent resin layer can be separated from each other when predetermined peeling force is applied. The surface characteristic of the transparent resin layer released from the sheet of conceal paper B is decided by the surface characteristic of the sheet of base paper used for the conceal paper B. When a sheet of high-gloss base paper is used for the sheet of conceal paper, a member having hidden information, which has a high-gloss electrophotographic image, can be formed.

This embodiment will be described below in detail on the basis of a specific example. However, the invention is not limited to this example at all.

In an electrophtographic apparatus, an adhesive layer, which is a transparent layer, is formed. A device for performing fixation of an image formed by electrophotographic system and bonding of the sheet of conceal paper simultaneously is used. In developing the transparent toner, a part of the developing device facing the photoconductor for the image formation apparatus of FIG. 1 is used to form the transparent toner layer. A polyimide film having a thickness of 70 μm and having a surface layer made of a silicone copolymer having a rubber hardness of 40 degrees and a thickness of 50 μm is used as the sheet of conceal paper. This example is the same as that in the first embodiment except for the aforementioned point.

Next, the detailed conditions for this embodiment will be described.

-Transparent Toner-

Linear polyester (molar ratio=5:4:1, Tg=62 degrees, Mn=4500, Mw=10000) obtained from terephthalic acid/bisphenol A ethylene oxide adduct/cyclohexane dimethanol is used as a binder resin. The binder resin is pulverized in a jet mill and then classified by a wind power classifier to prepare transparent fine particles with d50=11 μm. The following two kinds of inorganic fine particles A and B are deposited on 100 parts by weight of the transparent fine particles by a high-speed mixer.

The inorganic fine particles A are $SiO_2$ particles (having surfaces hydrophobic-treated with a silane coupling agent, a mean particle size of 0.05 μm, and an added amount of 1.0 part by weight). The inorganic fine particles B are $TiO_2$ particles (having surfaces hydrophobic-treated with a silane coupling agent, a mean particle size of 0.02 μm, a refractive index of 2.5 and an added amount of 1.0 part by weight).

-Conceal Paper-

A 70 μm-thick polyimide film is used as a base layer. A 50 μm-thick silicone copolymer having a rubber hardness of 40 degrees is used as a surface layer. For example, a highly heat-resistant sheet having a thickness of 10 to 300 μm can be used as the base layer. Examples of the base layer include polymer sheets of polyester, polyethylene terephthalate, polyether-sulfone, polyether-ketone, polysulfone, polyimide, polyimide-amide, polyamide, etc. A highly releasable resin layer can be used as the surface layer. Example of the surface layer include a tetrafluoroethylene-perfluoroalkyl vinyl ether copolymer, and polytetrafluoroethylene.

As described above, in this embodiment, because fixation of non-fixed toner and transparent toner to the sheet of recording paper P and bonding of the sheet of conceal paper B to the sheet of paper P are performed by a single fixing device and simultaneously, a member having hidden information can be produced by an apparatus small in size and easy to maintain.

For the same reason as described in the first embodiment, this embodiment has a secondary effect that production efficiency can be improved when a high-gloss electrophotographic image is produced.

Third Embodiment

This embodiment is an image output service in which a computer connected to the Internet prints contents edited by a user on a postcard on behalf of the user, hinds required part of the contents behind a sheet of conceal paper, and mails the postcard to a destination designated by the user.

Figure 5:
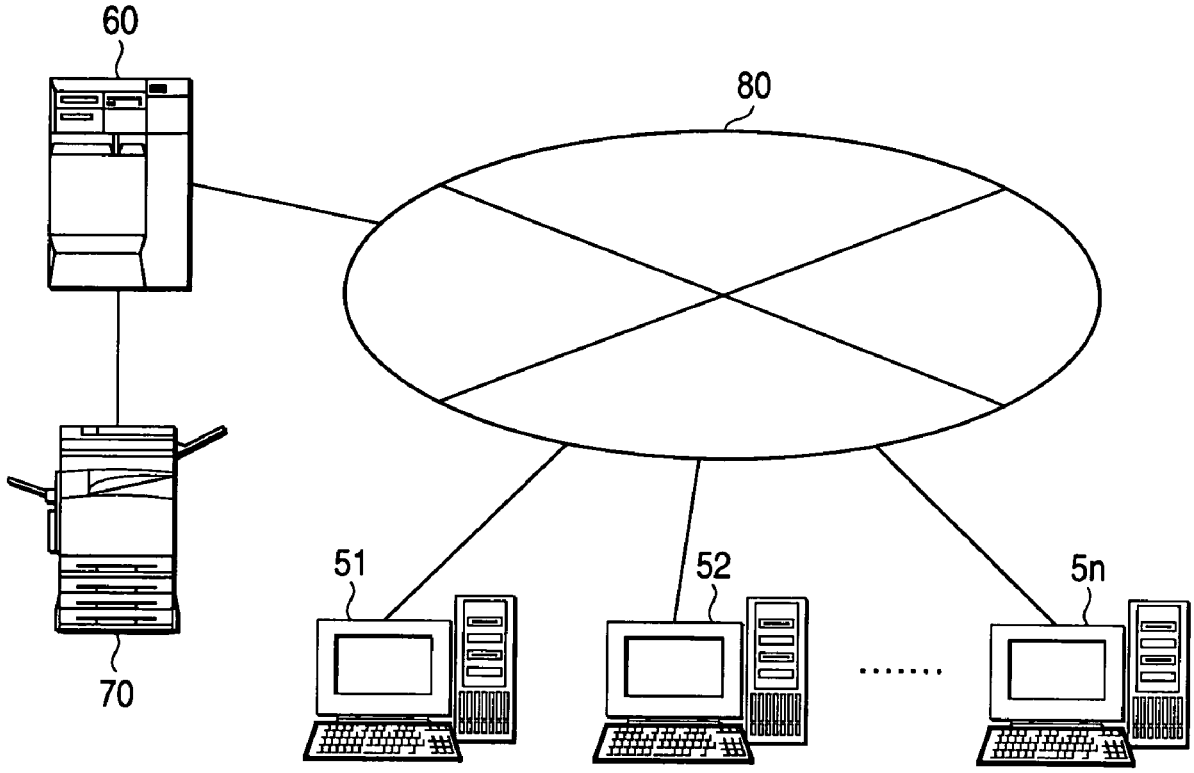
FIG. 5 is a diagram showing the overall configuration of a system according to a third embodiment of the invention.

FIG. 5 is a diagram showing an example of configuration of a system for achieving the image output service. As shown in FIG. 5, the system according to this embodiment has terminal apparatuses 51, 52, . . . , 5*n*, a server computer (hereinafter referred to as "server") 60, an image formation apparatus 70, and a communication network 80 such as the Internet for connecting the terminal apparatus, the server and the image formation apparatus to one another.

The terminal apparatuses 51, 52, . . . , 5*n* are information processing terminals such as PCs (Personal Computers), PDAs (Personal Digital Assistances), etc. Assume that software such as a Web browser for accessing the server 60 through the communication network 80 has been installed in each terminal apparatus.

For example, the server 60 serves as a WWW server in the Internet. Assume that the server 60 in this embodiment is a server further has a function of controlling the image formation apparatus 70. Although FIG. 5 shows the case where one server is used as the server 60, the function of the WWW server and the function of controlling the image formation apparatus 70 may be achieved by two servers respectively.

Assume that the image formation apparatus 70 has a function of producing a member having hidden information as shown in FIGS. 1 to 3. Although FIG. 5 shows the case where the server 60 and the image formation apparatus 70 are connected to each other by a local line on the assumption that the server 60 and the image formation apparatus 70 are placed in a geographically narrow region such as one shop, the server 60 and the image formation apparatus 70 may be connected to each other by the communication network 80 when the server 60 and the image formation apparatus 70 are placed in regions distant from each other.

The user can make access to the server 60 by operating an application program (hereinafter referred to as "application") such as a Web browser on any one (e.g. terminal apparatus 51) of the terminal apparatuses 51, 52, . . . , 5*n*. The user can operate the application to generate an image and a sentence such as a comment message by sending and pasting an image onto the rear surface of a postcard or by selecting an image file provided by the server 60 and pasting the selected image file onto the rear surface of the postcard. The user can operate the application to generate an image layout for mailing the postcard by inputting a destination address on the front surface of the postcard. When the user wants to give an instruction to hide part of the input image, the designation as to what region of the image is to be hidden can be sent to the server 60.

Next, the configuration of the server 60 for making the image output service possible will be described.

Figure 6:
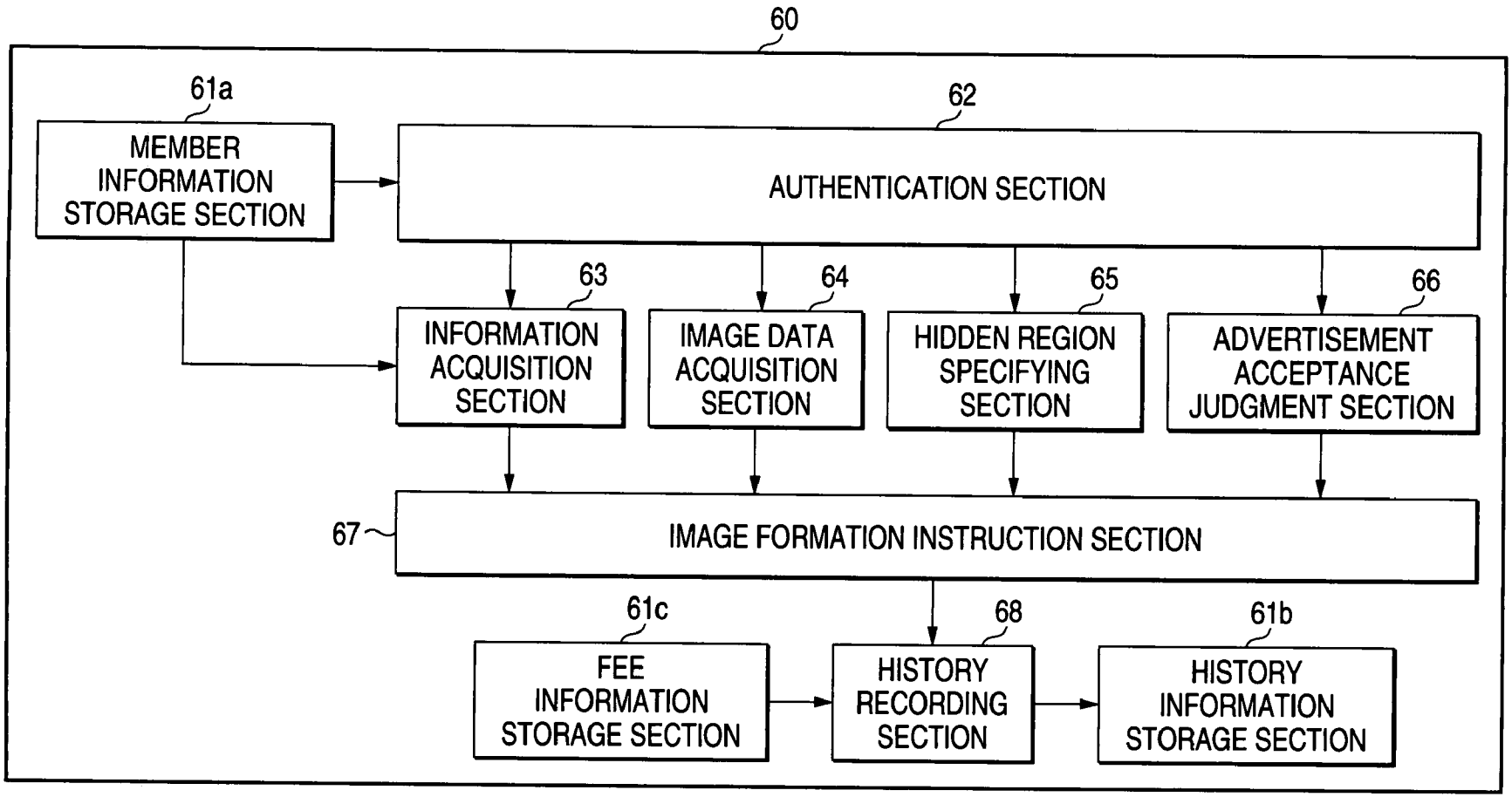
FIG. 6 is a diagram showing the configuration of a server in the third embodiment of the invention.

As shown in FIG. 6, the server 60 includes a member information storage section 61*a*, a history information storage section 61*b*, a fee information storage section 61*c*, an authentication section 62, an information acquisition section 63, an image data acquisition section 64, a hidden region specifying section 65, an advertisement acceptance judgment section 66, an image formation instruction section 67, and a history recording section 68.

The member information storage section 61*a* is a section for storing information of each user registered as a member in advance to request the image output service in order to produce a member having hidden information.

As shown in FIG. 7A, data such as an ID for uniquely identifying each user, a password used for authentication at the time of each user's receiving the service, a name of each user, an address of each user, a payment mode (credit/prepaid) for the service, and the remainder of money in the payment mode of "prepaid" are stored in the member information storage section 61*a* while the data are associated with one another.

The history information storage section 61*b* is a section for storing the history of instructions for producing a member having hidden information.

As shown in FIG. 7B, data such as a date of instruction for producing each member having hidden information, an ID of the user requesting the service to produce the member having hidden information, a destination name for mailing the member having hidden information, a destination address for mailing the member having hidden information, address information of an image data storage region in which the image data as the original of an image formed on the member having hidden information are stored, a flag as to whether or not an advertisement is used on the sheet of conceal paper in the member having hidden information, and a fee imposed on the user as a requester are stored in the history information storage section 61*b* while the data are associated with one another. Incidentally, the image data storage region is provided so that the image is stored without any change when the entire image sent by the user is to be hidden, and that the image is stored so that a region to be hidden can be recognized clearly when a part of the image sent by the user can be hidden.

The fee information storage section 61*c* is a section for storing the fee at the time of putting the advertisement on the sheet of conceal paper in the member having hidden information and the fee at the time of putting no advertisement on the sheet of conceal paper.

For example, FIG. 7C shows a case where a fee of 100 yen per postcard is charged when an advertisement is put on the sheet of conceal paper, and a fee of 200 yen per postcard is charged when the advertisement is not put on the sheet of conceal paper.

The authentication section 62 is a section for collating the ID and password input by the user with the ID and password stored in the member information storage section 61*a* and permitting the user to use service when the input ID and password are identical with the stored ID and password. The information acquisition section 63 is a section for acquiring information such as a name, an address, etc. corresponding to the ID input by the user. The image data acquisition section 64 is a section for acquiring image data input by the user. The hidden region specifying section 65 is a section for specifying the region of the input image data to be hidden. The advertisement acceptance judgment section 66 is a section for judging whether or not an advertisement is put on the sheet of conceal paper in the member having hidden information. The image formation instruction section 67 is a section for instructing the image formation apparatus 70 to produce a member having hidden information on the basis of a result of the process made by the information acquisition section 63, the image data acquisition section 64, the hidden region specifying section 65 and the advertisement acceptance judgment section 66. The history recording section 68 is a section for recording the history of instructions for producing a member having hidden information in the history information storage section 61*b* while referring to the fee information storage section 61*c*.

Although each of these functional portions can be achieves by only hardware, it can be also achieved by a combination of hardware and software. In the latter case, a CPU (Central Processing Unit) (not shown) of the server 60 reads a program stored in an auxiliary storage device not shown and executes the program to thereby achieve each function.

The program may be downloaded and installed in the server 60 by using wire or wireless communication device.

Figure 8:
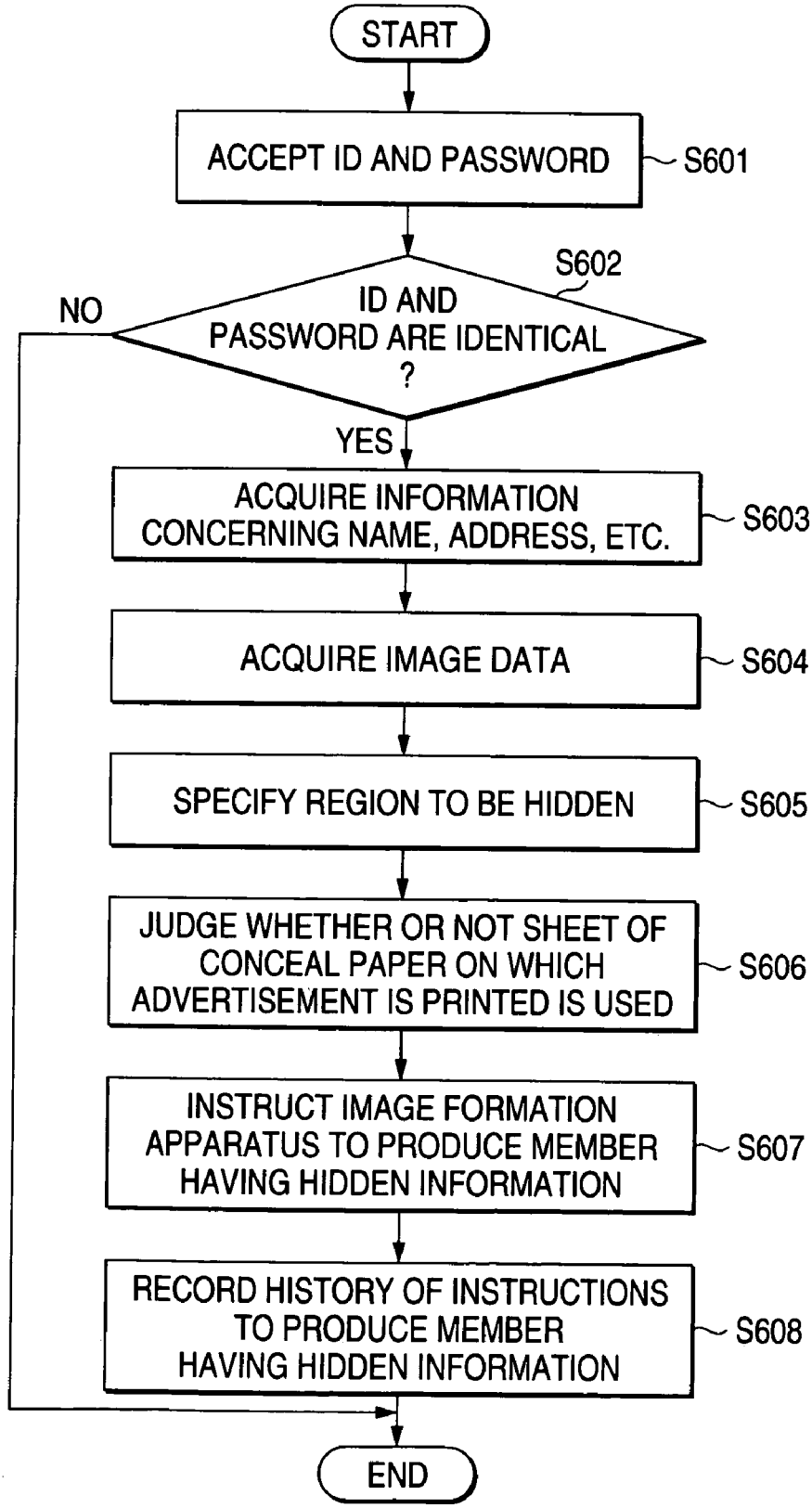
FIG. 8 is a flow chart showing the operation of the server in the third embodiment of the invention.

Next, the operation of the server 60 in this embodiment will be described with reference to FIG. 8. When the user inputs his or her ID and password and sends them to the server 60 while a homepage provided by the server 60 is displayed on the terminal apparatus 51, this operation starts.

When the operation starts, the authentication section 62 first receives the ID and password from the user (step 601) and judges whether or not the received ID and password are identical with the ID and password stored in the member information storage section 61*a* or not (step 602). If a decision is made that the received ID and password are not identical with the stored ID and password, the server 60 sends a message indicating rejection of service back to the terminal apparatus 51 and the operation is terminated. If a decision is made that the received ID and password are identical with the stored ID and password, the server 60 acquires various information required to instruct the image formation apparatus 70 to produce a member having hidden information.

Specifically, the information acquisition section 63 acquires information concerning the sender of the member having hidden information and information concerning the destination of the member having hidden information (step 603). With regard to the information concerning the sender of the member having hidden information, the information acquisition section 63 acquires information such as a name, an address, etc. corresponding to the ID received in the step 601 from the member information storage section 61*a*. With regard to the information concerning the destination, the information acquisition section 63 acquires a name, an address, etc. selected from an address book by the user if the address book has been registered in the server 60 by the user in advance. Alternatively, the information acquisition section 63 may acquire a name, an address etc. input in the terminal apparatus 51 by the user.

Next, the image data acquisition section 64 prompts the user to input image data and then acquires the image data input by the user (step 604).

The hidden region specifying section 65 specifies the region to be hidden from the image data acquired in the step 604 (step 605). For example, when all the image data sent from the user to the server 60 are regarded as image data to be hidden, the hidden region specifying section 65 specifies all the image data received from the user as the region to be hidden. When the user needs to designate clearly a region to be hidden from the image data sent to the server 60, the user operates to designate the region to be hidden from the image on the terminal apparatus 51. In this case, the hidden region specifying section 65 specifies the region to be hidden on the basis of the user's operation.

The advertisement acceptance judgment section 66 judges whether or not an advertisement is put on the sheet of conceal paper in the member having hidden information (step 606). This judgment may be made on the basis of declaration of user's will input in the terminal apparatus 51. Alternatively, this judgment may be made on the basis of declaration of user's will, which has been registered in the member information storage section 61*a* in advance while associated with the ID. Further alternatively, the advertisement acceptance judgment section 66 makes the judgment automatically based on some rules.

Although the steps 603 to 606 are processed in this order, the sequence of the steps 603 to 606 may be changed at option.

Then, the image formation instruction section 67 instructs the image formation apparatus 70 to produce the member having hidden information (i.e. form an image on a sheet of recording paper and bond a sheet of conceal paper to the sheet of recording paper) by sending information concerning the sender and the destination acquired by the information acquisition section 63, the image data acquired by the image data acquisition section 64, the information of the hidden region specified by the hidden region specifying section 65 and a result of the judgment performed by the advertisement acceptance judgment section 66, to the image formation apparatus 70 (step 607).

In accordance with this instruction, the image formation apparatus 70 forms an image on the sheet of recording paper and bonds the sheet of conceal paper to the specified hidden region on the basis of the information concerning the sender and the destination and the image data. On this occasion, a sheet of paper corresponding to the judgment result, which relates to the advertisement and is transmitted from the server 60, is used as the sheet of conceal paper. Incidentally, the method for supplying the sheet of conceal paper may be conceived as follows. For example, the judgment result transmitted from the server 60 is displayed on a display device provided in the image formation apparatus 70. A shop member supplies a sheet of conceal paper corresponding to the acceptability of advertisement on the basis of the displayed judgment result. Alternatively, a device for supplying a sheet of conceal paper acceptable of advertisement, a device for supplying a sheet of conceal paper non-acceptable of advertisement, and a device for switching over these devices may be provided so that the device for supplying a sheet of conceal paper can be switched over automatically by the image formation apparatus 70 on the basis of the judgment result transmitted from the server 60.

On the other hand, the history recording section 68 records the history of instructions for producing members having hidden information, in the history information storage section 61*b* (step 608). Specifically, information as shown in FIG. 7B is recorded as a history. Incidentally, information concerning the fee imposed on the user for production of the member having hidden information at this time is recorded in the "fee" column. The information concerning the fee is recorded by referring to the information shown in the fee information storage section 61*c* in FIG. 7C. That is, when the judgment in the step 606 results in acceptance of advertisement, a fee of 100 yen corresponding to the acceptance of advertisement is recorded in the fee information storage section 61*c*. When the judgment in the step 606 results in denial of advertisement, a fee of 200 yen corresponding to the denial of advertisement is recorded in the fee information storage section 61*c*.

Then, the image formation apparatus 70 produces the member having hidden information and makes preparations for mailing the member having hidden information to the designated destination. At predetermined timing after the completion of preparations for mailing the member having hidden information is confirmed, the fee is charged on the user who requests the mailing of the member having hidden information, on the basis of the fee information recorded in the "fee" column in the history information storage section 61*b*. Specifically, if the fact that the payment mode of the user is "credit" is recorded in the member information storage section 61*a*, the fee is charged through a credit company. If the fact that the payment mode of the user is "prepaid" is recorded in the member information storage section 61*a*, the amount of money stored in the "fee" column in the history information storage section 61*b* is subtracted from the amount of money stored in the "remainder of money" column in the member information storage section 61*a*. The resulting amount of money is rewritten in the "remainder of money" column in the member information storage section 61*a*.

Figure 9A:
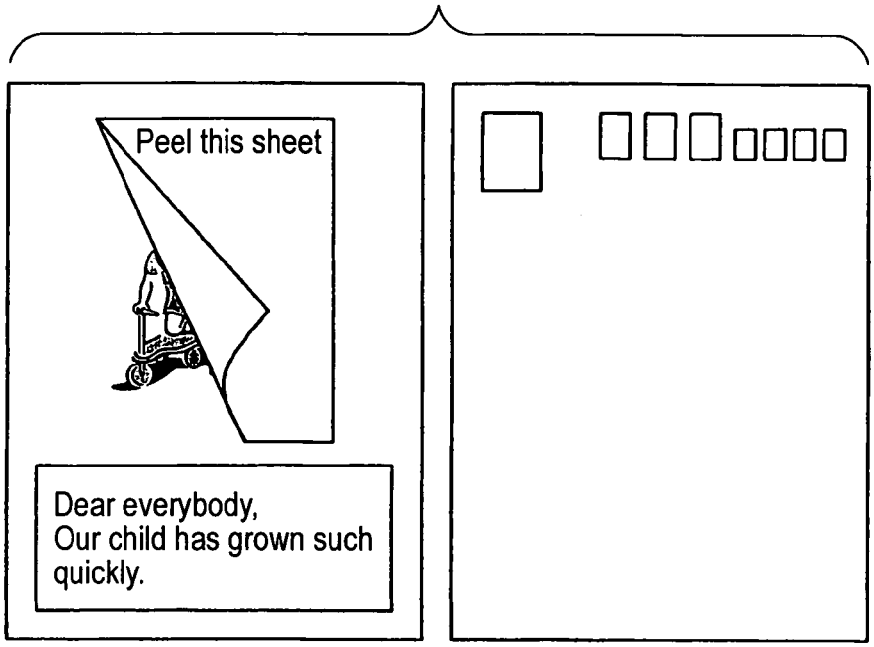
FIGS. 9A to 9C are views showing examples of the member having hidden information produced and mailed in the third embodiment of the invention.
Figure 9B:
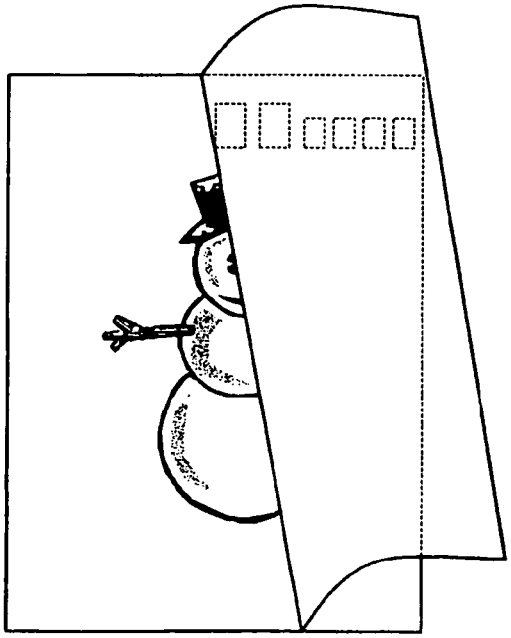
Figure 9C:
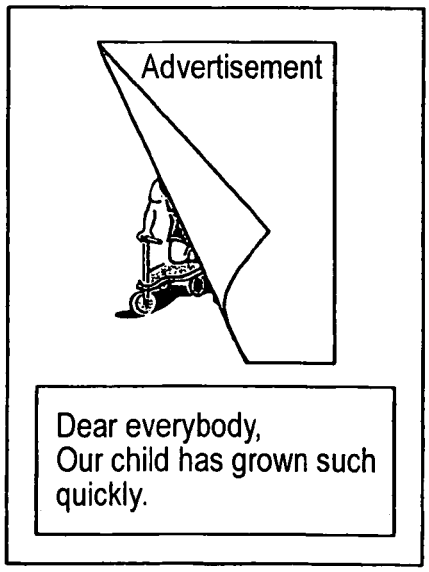

FIGS. 9A to 9C show examples of a member having hidden information produced and mailed by the aforementioned process. A person receiving such a member having hidden information can view a high-gloss photograph etc. added to the postcard by peeling the sheet of conceal paper.

When used is the image formation apparatus according to the embodiments of the invention in which the conventional image formation apparatus and the apparatus for producing a member having hidden information are combined, the following effects can be obtained. (1) A postcard can be produced while information such as family's photograph, which is privacy information of a user, can be kept secret not only from the mailing route but also from the shop member engaging in producing the postcard in the shop where the server and the image formation apparatus are placed. (2) The high-gloss high-quality photographic image added by the user can be prevented from being stained, damaged and broken in the transparent resin layer due to poor handling on the mailing route. (3) Although production efficiency of the image formation apparatus according to the related art is low because a sufficient cooling/peeling time must be kept for forming a high-gloss and uniform transparent resin layer, production efficiency of the image formation apparatus according to the embodiment of the invention can be improved because cooling/peeling is not required.

In this embodiment, a sheet of conceal paper acceptable of advertisement can be used. A system is configured so that the print fee is reduced when a sheet of conceal paper acceptable of advertisement is used. As a result, the postcard can be kept as a general postcard without advertisement after the receiving person views and peels the advertisement while the economical merit is given to the postcard production requester.

Although this embodiment has been described on the assumption that an apparatus capable of performing fixation of an image on the sheet of recording paper and bonding of the sheet of conceal paper simultaneously as in the first and second embodiments is used as the image formation apparatus 70, any image formation apparatus may be used if it has a function of producing a member having hidden information.

What is claimed is:

1. An apparatus for producing a member having hidden information in which a sheet of conceal paper for hiding the information and a sheet of recording paper having an image recorded thereon are bonded releasably, the apparatus comprising:

a recording paper supply section that supplies the sheet of recording paper;

a conceal paper supply section that supplies the sheet of conceal paper; and a fixing section that fixes the image, which is formed on the sheet of recording paper supplied from the recording paper supply section, onto the sheet of recording paper, and bonds the sheet of conceal paper supplied from the conceal paper supply section to the sheet of recording paper simultaneously.

2. The apparatus according to claim 1, wherein the fixing section presses a transparent resin layer formed in advance on a surface of the sheet of conceal paper, which faces the sheet of recording paper, while heats the transparent resin layer to bond the sheet of conceal paper to the sheet of recording paper.

3. The apparatus according to claim 1, further comprising:

a transparent resin formation section that forms a transparent resin layer on a surface of the sheet of recording paper supplied from the recording paper supply section, wherein:

the surface of the sheet of recording paper faces the sheet of conceal paper; and the fixing section presses the transparent resin layer formed by the transparent resin layer formation section while heats the transparent resin layer to bond the sheet of conceal paper to the sheet of recording paper.

4. The apparatus according to claim 3, wherein the transparent resin formation section forms a layer of transparent thermoplastic particles as the transparent resin layer.

5. A method of producing a member having hidden information in which a sheet of conceal paper for hiding the information and a sheet of recording paper having an image recorded thereon are bonded releasably, the method comprising:

supplying the sheet of recording paper;

supplying the sheet of conceal paper; and simultaneously fixing the image, which is formed on the sheet of recording paper supplied, onto the sheet of recording paper, and bonding the sheet of conceal paper supplied to the sheet of recording paper.

6. An image formation apparatus comprising:

an image carrier that carries a toner image;

a recording paper supply section that supplies a sheet of recording paper;

a transfer section that transfers the toner image, which is carried on the image carrier, onto the sheet of recording paper supplied from the recording paper supply section;

a conceal paper supply section that supplies a sheet of conceal paper for hiding information; and a fixing section that fixes the image, which is transferred by the transfer section, onto the sheet of recording paper, and bonds the sheet of conceal paper supplied from the conceal paper supply section to the sheet of recording paper simultaneously.

7. The image formation apparatus according to claim 6, wherein the fixing section presses a transparent resin layer formed in advance on a surface of the sheet of conceal paper, which faces the sheet of recording paper, while heats the transparent resin layer to bond the sheet of conceal paper to the sheet of recording paper.

8. The image formation apparatus according to claim 6, further comprising:

a transparent resin formation section that forms a transparent resin layer on a surface of the sheet of recording paper supplied from the recording paper supply section, wherein:

the surface of the sheet of recording paper faces the sheet of conceal paper; and the fixing section presses the transparent resin layer formed by the transparent resin layer formation section while heats the transparent resin layer to bond the sheet of conceal paper to the sheet of recording paper.

9. The image formation apparatus according to claim 8, wherein the transparent resin formation section forms a layer of transparent thermoplastic particles as the transparent resin layer.

* * * * *